United States Patent [19]

Khare

[11] 4,282,178

[45] Aug. 4, 1981

[54] USE OF HYDRAZINE COMPOUNDS AS CORROSION INHIBITORS IN CAUSTIC SOLUTIONS

[75] Inventor: Gyaneshwari P. Khare, Wichita, Kans.

[73] Assignee: Vulcan Materials Company, Wichita, Kans.

[21] Appl. No.: 172,703

[22] Filed: Jul. 25, 1980

Related U.S. Application Data

[63] Continuation-in-part of Ser. No. 94,390, Nov. 15, 1979, abandoned.

[51] Int. Cl.[3] ..... C23F 11/06

[52] U.S. Cl. ..... 422/13; 23/306; 23/307; 106/14.15; 159/DIG. 13; 203/7; 252/390; 423/269

[58] Field of Search ..... 106/14.15; 252/79.5, 252/390, 394; 423/269, 194; 23/302 R, 302 T, 306, 307; 159/DIG. 13; 203/7; 422/13

[56] References Cited

U.S. PATENT DOCUMENTS

| | | | |
|---|---|---|---|
| 2,258,545 | 10/1941 | Davies | 423/197 |
| 2,403,789 | 7/1946 | Cummins | 423/184 |
| 2,404,453 | 7/1946 | Osborne et al. | 204/153 |
| 2,562,169 | 7/1951 | Brumbaugh | 423/179 |
| 2,610,105 | 9/1951 | Pye | 423/186 |
| 2,790,707 | 4/1957 | Johnson | 423/199 |
| 2,823,177 | 2/1958 | Osborne | 204/295 |
| 2,889,204 | 6/1959 | Meyer et al. | 423/179 |
| 3,042,491 | 7/1962 | Smith | 423/181 |
| 3,325,251 | 6/1967 | Van den Okker | 423/269 |
| 3,728,281 | 4/1973 | Marks et al. | 106/14.15 |
| 3,962,113 | 6/1976 | Schiessl et al. | 423/219 |

OTHER PUBLICATIONS

Chem. Abs., 84:137943p; 78:18401b; 63:9519f; 61:6655c; 79:138308u; 79:80874g; 78:161639r; 79:23333k.

*Primary Examiner*—Lorenzo B. Hayes

*Attorney, Agent, or Firm*—Burns, Doane, Swecker & Mathis

[57] ABSTRACT

The addition of a small amount of hydrazine or a derivative or salt thereof serves to inhibit the corrosive effect of caustic such as sodium hydroxide on metal surfaces during the manufacture of the caustic or in processes using same. For instance, aqueous sodium hydroxide solutions having hydrazine or a derivative or salt thereof added thereto in an effective concentration in the range of from as little as about 2 ppm or less and up to about 1000 ppm, preferably of from about 2 to about 200 ppm, and most preferably from about 3 to about 40 ppm, can be concentrated by evaporation in nickel or nickel alloy equipment at temperatures as high as 150°-175° C. without causing undue corrosion.

10 Claims, 1 Drawing Figure

USE OF HYDRAZINE COMPOUNDS AS CORROSION INHIBITORS IN CAUSTIC SOLUTIONS

RELATED APPLICATION

This application is a continuation-in-part of application Ser. No. 94,390 filed Nov. 15, 1979 now abandoned.

BACKGROUND OF THE INVENTION

This invention relates to caustic solutions having a greatly reduced corrosive effect on nickel-containing metal surfaces. More particularly, it relates to the use of hydrazine or its salts or derivatives as corrosion inhibitors in caustic soda or caustic potash solutions. Still more particularly, it relates to an improvement in the manufacture of concentrated caustic soda solutions wherein hydrazine or its salts or derivatives are added in an extremely small but effective amount to the caustic soda solution prior to its final dehydration such that the otherwise severe corrosion of the nickel evaporation equipment in which such dehydration is normally conducted is greatly reduced or eliminated.

With an increased emphasis on energy conservation, new plants for the manufacture of caustic soda or potash are being designed with an increasing number of evaporation stages wherein relatively dilute caustic alkali solutions are dehydrated to produce commercially desired solutions containing alkali metal hydroxide concentrations of at least 40 percent. As a consequence, higher temperatures are being employed in the final evaporation stages of such new plants than in plants based on earlier designs and more serious corrosion of the customarily employed nickel equipment consequently occurs.

Corrosion control has been equated in the past with the complete elimination of oxidants, especially the chlorates normally present in caustic soda coming from a diaphragm cell. A wide variety of methods have been proposed for this purpose. See, for instance, CA79:138308u; CA79:80874g; CA78:161639r; CA79:23333k; CA78:18401b; CA67:557888b; CA63:9519f; CA61:6655c; CA57:P9458*i; U.S. Pat. No.* 3,042,491; U.S. Pat. No. 2,889,204; U.S. Pat. No. 2,823,177; U.S. Pat. No. 2,790,707; U.S. Pat. No. 2,735,730; CA50:9941b; U.S. Pat. No. 2,610,105; U.S. Pat. No. 2,562,169; Brit. Pat. No. 642,946 (Sept. 13, 1950); Brit. Pat. No. 597,564 (Jan. 28, 1948); U.S. Pat. No. 2,415,798; U.S. Pat. No. 2,404,453; U.S. Pat. No. 2,403,789; German Pat. No. 708,059 (June 5, 1941); U.S. Pat. No. 2,258,545; French Pat. No. 799,632 (June 16, 1936).

More recently, U.S. Pat. No. 3,325,251 has disclosed a method of reducing oxidative attack on nickel-containing metal surfaces during the dehydration of aqueous caustic solutions which involves the addition of formic acid, oxalic acid, or their sodium or potassium salts, in an amount of 50 to 500 ppm based on the NaOH or KOH content of the solution. However, this patent specifically suggests that larger amounts of the reducing agent may be required when the caustic liquor to be evaporated contains considerable quantities of an oxidizing substance such as a chlorate and/or oxygen.

Several of these prior methods have been or are being used commercially, but the use of sodium sulfite to control oxidizing agents in caustic liquors is probably mostly widely practiced because of its cost advantage over many or most of the other methods previously suggested for oxidant removal. There are, however, also significant disadvantages related to the use of sodium sulfite as a corrosion inhibitor in concentrated caustic alkali metal hydroxide solutions, because of its limited solubility (at 100° C., the solubility of sodium sulfite in 42% sodium hydroxide saturated with sodium chloride was found to be only 0.114 wt %) and because of resultant increased levels of sodium sulfate in both the caustic soda or potash product and in recycled brine from such dehydration processes. This is then disadvantageous to brine recycled to electrolytic cell processes.

In connection with a different art and a different problem, it may be mentioned that U.S. Pat. No. 3,620,777 suggests the inclusion of 2 to 20 g/l of hydrazine hydrate or hydrazine salt, in a chromate coating solution, which coating is said to impart good corrosion resistance to zinc alloy surfaces such as galvanized steel. However, this patent emphasizes the need for keeping the pH value of the coating solution within the distinctly acid range of 0.8 to 3.5 and emphasizes that the existence of any matter, except zinc, that would cause the rise of the pH of the solution above 3.5 is not desirable and that the addition of an alkali metal ion should be avoided. This reference does not address the problem of corrosion of nickel-containing surfaces, and in fact that applicability of its teachings to an alkali metal containing system is expressly contraindicated.

It has now been discovered that hydrazine and its salts and derivatives when used in very small but effective proportions, such as 1,000 ppm or less, preferably 200 ppm or less and most preferably 40 ppm or less, serve as excellent corrosion inhibitors when caustic liquor is dehydrated or otherwise processed in equipment made of nickel or alloys composed prodominantly of nickel, and that the effectiveness of this new method of corrosion inhibition surprisingly does not seem to depend on the substantial elimination of oxidant impurities from the caustic liquor. In fact, the invention is effective even when the hydrazine inhibitor is added to the caustic solution in a proportion substantially smaller than that required to reduce all of the oxidizing agent present, e.g., chlorate to chloride. For instance, the addition of as little as 1% or less of the stoichiometric amount of hydrazine offers significant protection.

There is considerable literature on the use of hydrazine as a corrosion inhibitor for steam boilers, i.e., as a corrosion inhibitor for steel surfaces exposed to substantially neutral or acidic water. However, the use of hydrazine as a corrosion inhibitor for nickel or nickel alloys in contact with concentrated caustic liquors does not appear to have been proposed. In steam boiler applications, hydrazine is used primarily as a molecular oxygen scavenger. As pointed out in the trade literature, the key mechanism for hydrazine as a corrosion inhibitor with steel boilers is not merely its direct reaction with the dissolved oxygen in the feed water, but also, and importantly, the development of a dense, protective coating of magnetite, $Fe_3O_4$, to which ferric oxide already formed on the steel surface is reduced by the reaction with hydrazine. See brochure 731-006R, entitled "SCAV-OX 35% Hydrazine Solution for Corrosion Protection In High, Medium and Low Pressure Boilers", published in 1978by Olin Chemicals, 120 Long Ridge Road, Stamford, Connecticut 06904.

Further, the use of alkyl hydrazines for the removal of free oxygen from liquids or gases at ambient or low temperature so as to avoid corrosion of boilers, ducts, pipes and the like has been proposed in U.S. Pat. No. 3,962,113, especially for water at a pH between about 3 and 8, i.e., essentially neutral or acid streams in which hydrazine itself is said to be relatively ineffective.

Hydrazine hydrate has also been proposed in the past as a reagent for the substantially complete decomposition of chlorate in aqueous alkali metal hydroxide. See CA84:137943p, Japan Kokai No. 73,134,996, Oct. 25, 1975. According to this proposal, hydrazine hydrate is added to the chlorate-containing caustic liquor, in the presence of iron as a catalyst, in an amount substantially greater than the stoichiometric amount required for the reduction of the chlorate to chloride. However, the cost of the proposed chlorate removal reagent is very high at the indicated concentrations. Furthermore, residence times required for the proposed chlorate removal are very long and the iron catalyst that is disclosed to be required in this prior proposal results in an undesirable contamination of the final caustic soda product.

OBJECTS OF THE INVENTION

It is an object of this invention to provide alkali metal hydroxide solutions of low corrosivity with respect to nickel or nickel alloy surfaces.

It is among the objects of this invention to provide an improved method for reducing the corrosive effect of aqueous caustic liquors on processing equipment constructed of nickel or nickel alloys.

One particular object is to provide an improved process for the manufacture of concentrated caustic solutions from relatively dilute caustic liquors containing sodium chlorate as an impurity.

It is further an object of this invention to concentrate dilute alkali metal hydroxide solutions to a high degree, even to practically complete dehydration, by continuous evaporation in nickel or nickel-containing equipment without substantial corrosion of the equipment.

Still more particularly it is among the objects of this invention to provide an improved process for the production of concentrated caustic soda solutions from soda solutions such as those produced in an electrolytic cell wherein a chlorate-containing dilute soda solution is dehydrated by evaporation at elevated temperatures in multiple effect evaporators, and particularly in evaporators having inner surfaces composed of nickel or a nickel alloy.

A still further object is to provide an improved method for reducing the corrosion normally encountered when relatively dilute sodium hydroxide solutions containing sodium chlorate as an impurity are evaporated at elevated temperatures in contact with a nickel-containing metal surface in multiple effect evaporators, which method is economical in terms of cost of corrosion inhibitor required, is operative in the absence of any added iron or other catalyst, and does not depend on the substantially complete removal of the chlorate from the solution.

SUMMARY OF THE INVENTION

It should be understood that the term "caustic" in the sense used herein comprises solutions of sodium hydroxide or potassium hydroxide.

It should further be understood that, in the absence of an explicit indication to the contrary, amounts and proportions of materials are expressed on a weight basis throughout this specification and appended claims.

In accordance with one of its aspects, the present invention provides an aqueous caustic solution comprising a corrosion-inhibiting amount of hydrazine, or an inorganic or organic derivative thereof, or a mixture comprising a plurality of such compounds. More particularly, the hydrazine compound may be added to the caustic solution in an amount equal to between about 1% and about 100% or more, e.g., 3% to 50% of the stoichiometric amount required for a substantially complete reduction of any oxidizing agent present, e.g., for the reduction of any chlorate present to the chloride. Thus, for instance, about 2 to 1000 parts, preferably about 2 to 200 parts, and most preferably about 3 to about 40 parts hydrazine, or an equivalent amount of one of its said derivatives, may conveniently be added per one million parts (by weight) of the caustic solution.

Although it may be helpful to add the hydrazine compound to the caustic solution in a somewhat greater concentration within the stated range when a relatively high proportion of chlorate is present than when its proportion is very low, it is to be emphasized that the use of 50% or less, e.g., 1 to 25% of the stoichiometric proportion of the hydrazine compound is generally sufficient, as stated above. The amount of hydrazine compound required for effective corrosion protection in any given case depends not only on the concentration of chlorate present in the caustic solution, but to some extent also on such other factors as the presence of other oxidants, processing temperature, and flow rate of the solution along the corrodible surfaces.

In accordance with a particular embodiment, this invention provides an aqueous caustic soda solution of low corrosiveness toward metals such as nickel, which solution comprises about 25 percent or more, e.g., between 35 and 75 percent sodium hydroxide, sodium chlorate as an impurity in a concentration of about 1 percent or less, e.g., 0.02% to 1%, commonly about 0.03 to 0.15%, and about 2 to about 1,000 ppm, preferably 3 to 40 ppm, hydrazine or an equivalent amount of hydrazine derivative as a corrosion inhibitor.

In another aspect, the invention provides an improved method for processing chlorate contaminated aqueous caustic soda solutions in contact with a metal surface composed essentially or predominantly of nickel at an elevated temperature, wherein hydrazine or an equivalent amount of an inorganic or organic derivative thereof is added to the solution as a corrosion inhibitor in an effective amount equal to from about 1% or less to about 50% or more, e.g., 1% to 25%, of the stoichiometric amount relative to the chlorate present in the solution, e.g., in an amount between about 2 and about 200 ppm based on the weight of the caustic solution, and in the absence of any added oxidation-reduction catalyst.

While hydrazine itself, $N_2H_4$, is currently preferred for the purposes of this invention, its hydrate, $N_2H_4.H_2O$, and its various salts of strong inorganic acids such as hydrazine hydrochloride, hydrazine sulfate, hydrazine phosphate, etc., may be used likewise. Moreover, organic derivatives of hydrazine may also be used, but are less preferred because they tend to be less effective than the inorganic compounds in a strongly alkaline environment. Representative organic hydrazine derivatives include those disclosed in U.S. Pat. No. 3,962,113, e.g., alkyl hydrazines having a single alkyl group of 1 to about 10 carbon atoms, or dialkyl hydrazines wherein each alkyl contains from 1 to about 8 carbon atoms; and their associated inorganic acid salts may be used in a like manner.

The present invention is based at least in part on the surprising discovery that in the case of hydrazine and its equivalent derivatives the corrosion inhibiting action does not depend on the elimination of the chlorate impurity from the caustic liquor by direct chemical reaction, and that consequently a surprisingly small proportion of inhibitor, substantially less than the stoichiometric amount in relation to any chlorate present, can be used in practicing the present invention. Generally speaking, the hydrazine or equivalent hydrazine derivative is added to the caustic liquor in a concentration in the range between about 2 ppm and about 1,000 ppm, preferably between about 2 and about 200 ppm, a concentration in the range between about 3 and about 40 ppm being usually preferred in terms of economy and effectiveness in the commercial production of caustic soda.

While a relatively high concentration of chlorate impurity is present in the solution the addition of hydrazine in a concentration in the upper portion of the stated range is generally preferred, whereas when only a low proportion of chlorate impurity is present in the caustic liquor an amount of hydrazine in the lower portion of the stated range may be sufficient. The condition and prior history of the metal surface to be protected from corrosion, as well as the actual processing temperature, presence of other oxidants such as hypochlorite or chlorite, leakage of oxygen into the system, and flow rate of the solution through the system or its contact time with the corrodible surfaces, also can have some effect on the proportion of corrosion inhibitor required to be added for effective protection. In any event, the optimum amount is readily determined for any particular case by routine preliminary tests.

The present invention is useful whenever a solution containing sodium or potassium hydroxide contaminated with chlorate as an impurity is treated in contact with a metal surface composed of nickel or a nickel alloy wherein nickel forms the major component, or stainless steel, e.g., CA type stainless steel which is commonly used in caustic service. It is particularly useful when a chlorate-containing aqueous caustic liquor is maintained in contact with the nickel, nickel alloy or stainless steel surface at a temperature above 100° C., and particularly at a temperature between about 130° and 175° C.

The invention is of particular value in the manufacture of concentrated caustic soda solutions wherein a relatively dilute solution, for instance, a solution produced in a diaphragm cell, is evaporated in several consecutive stages at consecutively higher temperatures to produce a concentrated solution containing at least 40 percent sodium hydroxide, especially solutions containing 48 to 75 percent or more sodium hydroxide. Such solutions are preferably made by dehydration in triple or quadruple effect evaporators that are constructed of nickel metal or high nickel content alloys or of steel having an inner cladding of nickel or nickel alloy, although heat exchanger tubes in such systems are also commonly made of CA type stainless steel, e.g., E-Brite 26-1 manufactured by Trent Tube Division, Colt Industries. When multiple stage evaporation is used, all of the required corrosion inhibitor may be added in or ahead of the final evaporation stage, or the inhibitor may be added separately to each evaporation stage, in which event it may be preferred to add none or only a small proportion of the total corrosion inhibitor to the evaporation stage or stages that operate at temperatures below about 60° C., and to add the required amount of inhibitor principally or exclusively to the stage or stages that operate at temperatures above about 60° C.

While the invention is described in the specification principally in connection with the manufacture of concentrated caustic soda solutions based on the diaphragm cell process, it is similarly applicable to other caustic alkali manufacturing processes or to any chemical processes wherein processing equipment having nickel or nickel-containing surfaces is maintained in contact with a strongly alkaline, chlorate-containing alkali solution.

THE DRAWING

FIG. 1 of the drawing is a schematic flow diagram of a plant wherein a weak caustic solution is concentrated in a quadruple effect evaporation system to produce a commercially useful concentrated caustic soda product.

DETAILED DESCRIPTION OF THE INVENTION

Figure 1:
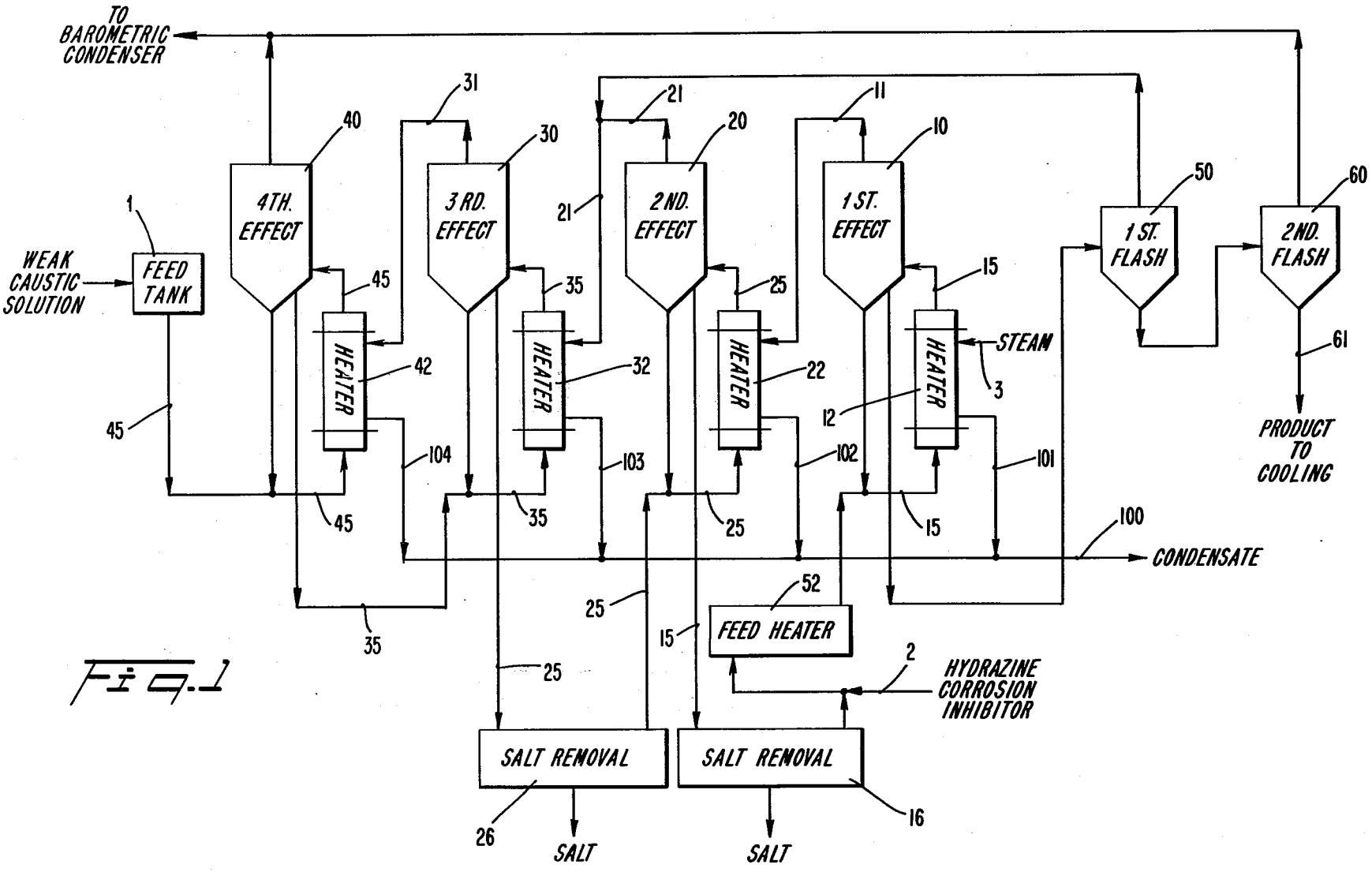

As the invention is of particular value in connection with the manufacture of concentrated caustic soda solutions, a representative embodiment of such a manufacture will now be described in detail for purposes of illustration of the present invention. However, while the diaphragm cell process is referred to in this embodiment as the source of the dilute sodium hydroxide solution to which the present invention is applied, it should be understood that the invention is similarly applicable to sodium hydroxide solutions obtained from other sources, e.g., from membrane cells, from mercury cells and from the lime-soda process.

Only about one-half of the sodium chloride in the feed brine to a diaphragm cell is electrolytically converted. The cell liquor is a composite of the unconverted sodium chloride brine, the electrolytically produced sodium hydroxide, any sodium sulfate impurity present in the cell feed, minor amounts of decomposition products such as sodium chlorate and sodium hypochlorite, and water. The overall caustic system typically performs the three-fold function of (a) concentrating the caustic to a commercial 50 weight percent concentration, (b) recovering the sodium chloride for recycle to the cells, and (c) purging sulfate from the overall chloralkali operation.

Concentration of the caustic has conventionally been done in three steps or effects. With greater emphasis on energy conservation newer plants are being designed featuring quadruple effect evaporation systems, as illustrated in the drawing. Referring to FIG. 1, a weak caustic solution such as the cell liquor from a diaphragm cell process (not shown) is fed from feed tank 1 to the fourth effect 40, concentrated and sent to the third effect 30, where it is concentrated further and sent to the second effect 20 and subsequently to the first effect 10, with further concentration being obtained in each effect. Differing orders of progression between effects are sometimes employed. Two liquor flash effects 50 and 60 are incorporated as part of the basic system to partially cool and further concentrate the hot caustic liquor by flash evaporating to lower pressure and temperature prior to discharging via line 61 to a final cooling and filtering system (not shown).

Steam introduced via line 3 is used as the primary heat source in the first effect. Vapors evaporated from the first effect 10 are then withdrawn via line 11 and used as the heat source in the second effect 20. Similarly the second effect vapors are passed via line 21 to the third effect 30 where they are used as a heat source. The third effect vapors are in turn removed via line 31 and used in the fourth effect 40. A natural balance of pressure and temperatures occurs between effects, dependent upon progressive concentration of the caustic liquors in each effect.

Heaters 12, 22, 32 and 42 are used as a means where extraneous steam or the vapors produced in the process are used to preheat the caustic solutions that are fed into the effects 10, 20, 30 and 40, via caustic lines 15, 25, 35 and 45, respectively. Steam condensate is withdrawn from the process via lines 100, 101, 102, 103 and 104, while sodium chloride removal is effected in stages 26 and 16.

While the quadruple effect evaporating system is highly efficient with respect to energy, the system usually requires higher process temperatures (about 130° to 180° C., e.g., 160° to 175° C.) in the more concentrated evaporative stage. It is primarily in this temperature range and at this point in the process that corrosion problems are most persistent and troublesome. In the system illustrated in FIG. 1, all of the hydrazine corrosion inhibitor is therefore shown as being introduced via line 2 into the caustic solution from the second effect 20 before it is further heated in heater 52 and before it is introduced into the first effect 10. However, as mentioned before, one can introduce the inhibitor portionwise at various stages of the process.

EXAMPLE 1

The effectiveness of the invention is illustrated in the first instance by the laboratory tests described below.

The apparatus used in conducting these tests consisted of a 300 ml stainless steel autoclave equipped with a Ni 200 thermowell, a gas inlet tube, and a nitrogen purge and vent system. The aqueous caustic soda solution and a test coupon were in each case contained inside a nickel reaction cup placed in the autoclave. The test coupons were either made of Ni 200 (99.5% Ni, 0.15% Fe, 0.05% Cu, 0.06% C, 0.05% S, 0.25% Mn) or a pair of nickel clad steel sheets welded together so as to expose only the nickel surface. Only about one-half to two-thirds of the test coupon was immersed in the caustic during the test. The tests were performed at 163°±3° C. (325° F.) and 2.4±0.1 bars (20±1 psig) pressure of nitrogen for a period of 3 hours. A majority of the runs were made in duplicate.

To simulate corrosive conditions found in a caustic processing plant, the test solution in each case was prepared to contain approximately 44 percent sodium hydroxide and 8 percent sodium chloride. Varying amounts of sodium chlorate were added to the test solutions as shown in Table I below. The inhibitor was added to the test solution prior to its being transferred to the reaction cup. After the corrosion test, the coupons were examined visually and a visually perceived corrosion rating assigned to them.

Corrosion of the immersed portion of the coupon was rated on an arbitrary scale of 1 to 10, with 10 being the worst corrosion observed. Excess corrosion of the coupon at the liquid/vapor line was also observed and rated in terms of the degree to which corrosion at the liquid/vapor line was worse than that found for the immersed portion. A scale of 1 to 5 was used, with 5 signifying the largest difference in corrosion between the two areas. Thus, referring as an example to Test B, Table I, the coupon was rated 8 and 1 in the two categories, signifying that without the addition of any inhibitor the coupon was very severely corroded in the immersed section but that the degree of corrosion at the liquid/vapor line was only slightly worse than in the immersed portion. On the other hand, in the case of Test D-2, wherein 0.368% $Na_2SO_3$ was added as the inhibitor, the rating of 3 and 3 means that the corrosion of the immersed portion was moderately bad, and the degree of corrosion at the liquid/vapor line was very substantially worse than in the immersed portion. A more complete discussion of the tabulated test results follows.

In Test A, in which the test solution only contained 44% reagent grade sodium hydroxide and 8% sodium chloride with no detectable amount of oxidants, the coupons showed little in the way of corrosion. In Test B, wherein 0.085% sodium chlorate but no inhibitor was added to the standard test solution, severe corrosion was obvious over the immersed portion of the nickel coupon and was even worse at the vapor/liquid interface.

A series of runs (C-1 to C-6) was then made with varying amounts of hydrazine being added to the standard solution. Surprisingly, very significant corrosion inhibition was observed in Tests C-1, C-2 and C-3, although only 720, 320 and 93 ppm, respectively, of hydrazine was added to these solutions and although nearly all of the initially present chlorate was still present in the solution after the corrosion test, as determined by chemical analysis. Only in Test C-4, in which only 29 ppm hydrazine was added to the test solution, was the test coupon seriously corroded.

The stoichiometric requirement for complete destruction of chlorate by hydrazine can be calculated from the equation:

$$2\ NaClO_3 + 3\ N_2H_4 \rightarrow 2\ NaCl + 3\ N_2 + 6\ H_2O \qquad \text{[Equation 1].}$$

On the basis of laboratory tests it appears that a practical degree of corrosion protection is offered by as little as 10 percent of the stoichiometric amount of hydrazine needed as per Equation I. Apparently the chlorate is essentially harmless to the metal surfaces at moderate temperatures and only the small proportion of the total chlorate that acts as an active oxidant at the more elevated temperatures must be scavenged by the inhibitor in order to provide effective corrosion protection. Addition of a reduction-oxidation catalyst is not required. An upper useful limit for the addition of hydrazine is determined more by economics than by technical considerations.

As shown in Table I, hydrazine may be added without any loss of effectiveness to the caustic solution either as a hydrate or in the form of an inorganic salt.

TABLE I

| | CORROSION TEST DATA | | | | | | | | | | |
|---|---|---|---|---|---|---|---|---|---|---|---|
| Test: | A | B | C-1 | C-2 | C-3 | C-4 | C-5 | C-6 | D-1 | D-2 | D-3 |
| Coupon | Ni 200 | Ni clad | Ni 200 | Ni 200 | Ni 200 | Ni 200 | Ni 200 | Ni 200 | Ni 200 | Ni 200 | Ni 200 |
| Corrosion Inhibitor. | none | none | | | | Hydrazine | | | | $Na_2SO_3$ | |

TABLE I-continued

| | CORROSION TEST DATA | | | | | | | | | | |
|---|---|---|---|---|---|---|---|---|---|---|---|
| Test: | A | B | C-1 | C-2 | C-3 | C-4 | C-5 | C-6 | D-1 | D-2 | D-3 |
| Source of Hydrazine. | — | — | b | c | c | c | d | d | — | — | — |
| Initial Sol., wt percent | | | | | | | | | | | |
| $NaClO_3$ | .000 | .085 | .14 | .142 | .084 | .158 | .084 | .084 | .14 | .138 | .063 |
| Inhibitor | .000 | .000 | .072 | .032 | .0093 | .0029 | .0039 | .0019 | .58 | .368 | .112 |
| Final Sol., percent recovered | | | | | | | | | | | |
| $NaClO_3$ | — | NA | 93 | 94 | 85 | 93 | NA | NA | 93 | 97 | NA |
| Inhibitor[a] | — | — | 39 | 0 | 0 | 0 | NA | NA | 4 | 34 | 55 |
| Corrosion Rating: | | | | | | | | | | | |
| Immersed portion of coupon | 1 | 8 | 2 | 2 | 2 | 6 | 2 | 3 | 1 | 3 | 7 |
| Vapor/liquid line on coupon | 1 | 1 | 1 | 1 | 1 | 2 | 5 | 5 | 2 | 3 | 3 |

[a]Detection limit for hydrazine in final solution is approximately 10 ppm.
b = $N_2H_4 \cdot 2HCl$; c = $N_2H_4 \cdot H_2O$, d = $N_2H_4 \cdot H_2SO_4$.
NA = Not analyzed.

In a similar manner, mono- and dialkyl hydrazines may be similarly useful corrosion inhibitors as hydrazine, since the chemistry of hydrazine is not basically altered by substitution of one or two hydrogen atoms by alkyl groups.

In any event the data show that even at the relatively high chlorate concentrations encountered in the tests hydrazine is a surprisingly effective corrosion inhibitor in caustic alkali solutions at concentrations in the range between about 50 and 1000 ppm, based on the weight of the solution.

Expressed in terms of its proportion to the chlorate present in the solution, hydrazine has been found in these laboratory tests to be an effective corrosion inhibitor when used in a proportion in excess of 5% of the stoichiometric amount of hydrazine required for complete destruction of chlorate, e.g., about 10% to 50%, or more, based on stoichiometry and the weight of the chlorate. It appeared to be insufficiently effective in these tests at temperatures above about 160° C. if present in a proportion of only about 2% based on stoichiometry and the weight of the chlorate, although plant-scale data obtained subsequently have shown that hydrazine can be an effective corrosion inhibitor even when present in substantially lower proportions.

In any event, the concentrations at which hydrazine or its inorganic or organic derivatives are effective as inhibitors are much lower than that required for a stoichiometric balance of the oxidant (chlorate) with reductant (hydrazine).

For comparative purposes, Tests D-1, D-2 and D-3 were made with sodium sulfite as the corrosion inhibitor. While sodium sulfite does offer some corrosion protection, it does so only at levels greater than 1,200 ppm, which are unattractive both from economic and process considerations.

The described tests were set up to simulate the final dehydration stage of the conventional 50% caustic manufacturing process, because it is in this process step that the highest temperatures and most concentrated caustic solutions occur. As a result of these conditions, this segment of the manufacturing process suffers the most severe corrosion problems. Obviously, however, the addition of hydrazine or its salts or derivatives to prevent corrosion is not limited to this portion of caustic manufacture but can be easily and equally effectively applied throughout the entire manufacturing process, as well as to other processes where oxidant-containing caustic solutions are used.

EXAMPLE 2

More recently, full-scale plant test runs illustrative of the invention have been performed in a plant corresponding to the system shown in FIG. 1. Referring to FIG. 1, varying amounts of hydrazine were added in these test runs via line 2 to the solution being fed to the first effect evaporator 10. During each test, the plant was operated for three to six days with the continuous addition of the inhibitor in the proportion shown in Table II. The chlorate concentration in the caustic solution feed was determined frequently to assure that the stoichiometric proportion between sodium chlorate and hydrazine was held substantially constant. Feed and effluent solutions were regularly analyzed for nickel using an atomic absorption technique. The results obtained are shown in Table II.

The amount of nickel pickup in the effluent is a direct measure of the corrosion suffered by the first effect evaporator, i.e., the higher the nickel pickup, the higher the corrosion. The corrosion rate is known to vary considerably in commercial production over an extended period, because it is dependent on the chlorate content of the caustic feed solution and this can undergo substantial variation from day to day. Typically, for instance, referring to the series of comparative tests shown in Table II, the chlorate content may vary from about 0.01 to 1 percent or more, more commonly from about 0.03 to about 0.15 percent. No inhibitor was used in test 1 and the amount of nickel pickup in the effluent in this three-day test was 1.16 ppm. By comparison, in tests 2 and 3 the addition of 0.00035 weight percent (3.5 ppm) and 0.0017 weight percent (17 ppm) hydrazine to the caustic solution resulted in a reduction of nickel pickup to 0.28 and 0.075 ppm respectively.

TABLE II

CONDITIONS AND RESULTS OF PLANT-SCALE HYDRAZINE ADDITION TESTS

| | Test 1 (Control) | Test 2 | Test 3 |
|---|---|---|---|
| Duration of test, days | 3 | 6 | 4 |
| NaOH in feed, wt% | 33.0 | 33.0 | 33.0 |
| $NaClO_3$ in feed, wt% | 0.054 | 0.070 | 0.037 |
| Hydrazine added | | | |
| Weight percent | 0 | 0.00035 | 0.0017 |
| Parts per million | 0 | 3.5 | 17.0 |
| Percent stoichiometric | 0 | 1.1 | 10.4 |
| Nickel pickup in effluent, ppm | 1.16 | 0.28 | 0.075 |

Thus it appears that a practical degree of corrosion protection is gained in a commercial-scale operation by as little as one percent or less of the stoichiometric amount of hydrazine as needed per Equation I, above, and that use of ten percent of the stoichiometric amount of hydrazine can reduce the normal corrosion rate by 90 percent or more. Based on the weight of the caustic solution, the addition of about 2 ppm or more, preferably 3 to 40 ppm, of the hydrazine compound provides useful and effective protection. Of course, greater proportion of the hydrazine compound, e.g., up to about 1000 ppm or more, can be used if desired or if special circumstances warrant.

While the invention has been specifically demonstrated primarily in terms of its effect on Nickel 200, it should be understood that it is similarly applicable to pure nickel, other nickel alloys such as "A" Nickel (99.4% Ni, 0.6% Co), nickel-copper alloys, Monel, (67% Ni, 30% Cu, 1.4% Fe, 1% Mn, 0.15% C, 0.1% Si, 0.01% S), nickel-chromium alloys, nickel-molybdenum-iron alloys, stainless steels, and other metals or alloys commonly used in processing caustic solutions.

It is to be understood that the invention which is intended to be protected is not to be construed as being limited to the particular embodiments disclosed, and that these are to be regarded as illustrative rather than limiting. Variations and changes may be made by those skilled in the art without departing from the spirit of the invention claimed.

I claim:

1. An aqueous solution comprising at least 10% by weight of an alkali metal hydroxide, chlorate as an impurity, and hydrazine or an inorganic or organic derivative thereof or a mixture of same in a corrosion inhibiting amount thereof which is equal to from about 1% to about 50% of the stoichiometric ratio thereof relative to the chlorate.

2. An aqueous solution according to claim 1 comprising at least 10% sodium hydroxide, sodium chlorate as an impurity, and hydrazine in a corrosion-inhibiting amount of up to 1000 ppm.

3. An aqueous caustic soda solution according to claim 1 and containing from about 10 to about 75% sodium hydroxide, chlorate as an oxidizing impurity, and, as a corrosion inhibitor, 3 to 40 ppm hydrazine or a mono- or dialkyl hydrazine wherein the alkyls contain a total of from 1 to about 16 carbon atoms or an equivalent amount of a salt of these compounds and an inorganic acid.

4. A caustic soda solution according to claim 3 which comprises sodium chlorate as an impurity.

5. In a process wherein an aqueous solution comprising at least 10% of sodium hydroxide is heated at a temperature between about 100° and 175° C. in contact with a metal surface composed in major part of nickel, the improvement which comprises adding to said solution a corrosion-inhibiting amount of hydrazine or an equivalent amount of an inorganic or organic derivative of hydrazine.

6. In a process for making a concentrated caustic solution containing between about 40% and about 80% sodium or potassium hydroxide by evaporation of water from a dilute aqueous solution containing between about 10% and about 35% of said hydroxide and a small amount of chlorate, said evaporation being conducted in a plurality of consecutive stages at consecutively higher temperatures such that at least one of said stages is at a temperature in the range between about 130° and about 175° C. while in contact with a metal surface composed of nickel as a major component, the improvement which comprises adding a corrosion-inhibiting amount of hydrazine or an inorganic or organic derivative of hydrazine to said dilute caustic solution.

7. A process according to claim 6 wherein said dilute solution is a sodium hydroxide solution containing from about 0.02 to 1% sodium chlorate and wherein hydrazine is added thereto in a stoichiometric proportion of from about 1% to about 50% relative to the chlorate.

8. A process according to claim 6 wherein said dilute solution is a sodium hydroxide solution from a diaphragm cell containing from about 0.02 to about 1% sodium chlorate, wherein said evaporation is conducted in at least two stages, and wherein said hydrazine or derivative thereof is added to said solution without addition of any reduction-oxidation catalyst.

9. A process according to claim 8 wherein said dilute solution is a sodium hydroxide solution containing from about 0.03 to 0.15% sodium chlorate and wherein hydrazine is added to said solution in an amount in the range of from about 3 to about 40 ppm.

10. A process according to claim 8 wherein hydrazine is added to said dilute solution at least in part subsequent to the evaporation stage that is operated at the lowest temperature and ahead of any stage that is operated at a temperature of at least 160° C.

* * * * *